US005399040A

United States Patent [19]

Holloway

[11] Patent Number: 5,399,040

[45] Date of Patent: Mar. 21, 1995

[54] DISPENSER WITH REPLACEABLE COSMETIC HOLDER

[75] Inventor: Thomas F. Holloway, Southbury, Conn.

[73] Assignee: Risdon Corporation, Naugatuck, Conn.

[21] Appl. No.: 88,213

[22] Filed: Jul. 6, 1993

[51] Int. Cl.[6] ..... A45D 40/06; A45D 40/16

[52] U.S. Cl. ..... 401/78; 401/89

[58] Field of Search ..... 401/78, 86

[56] References Cited

U.S. PATENT DOCUMENTS

| | | | |
|---|---|---|---|
| 3,146,881 | 9/1964 | Metreaud et al. | 401/86 X |
| 3,323,641 | 6/1967 | Landen | 401/86 |
| 3,758,218 | 9/1973 | Pfommer et al. | 401/86 |
| 4,505,607 | 3/1985 | Sugiyama | 401/78 |
| 4,812,066 | 3/1989 | Gueret | 401/86 X |
| 4,961,663 | 10/1990 | Iwamoto et al. | 401/86 X |

FOREIGN PATENT DOCUMENTS

| | | | |
|---|---|---|---|
| 672087 | 10/1963 | Canada | 401/86 |
| 2245544 | 1/1992 | United Kingdom | 401/78 |

*Primary Examiner*—Steven A. Bratlie

*Attorney, Agent, or Firm*—St. Onge Steward Johnston & Reens

[57] ABSTRACT

Containers for cosmetics such as lipstick, with refill cartridges that must be used with the whole container, avoid problems such as separation during normal use. The refill cartridge comprises a cosmetic holder including: a tubular innerbody, a tubular cam sleeve surrounding substantially the entire length of the innerbody; and an elevator cup within the innerbody. The extension of the cam sleeve over the innerbody, inhibits the relative movement of these two elements, unless a base member configured to fit between them and impart relative torque is in place. A retaining means is provided to hold the refill and the base member together.

3 Claims, 2 Drawing Sheets

FIG. 4
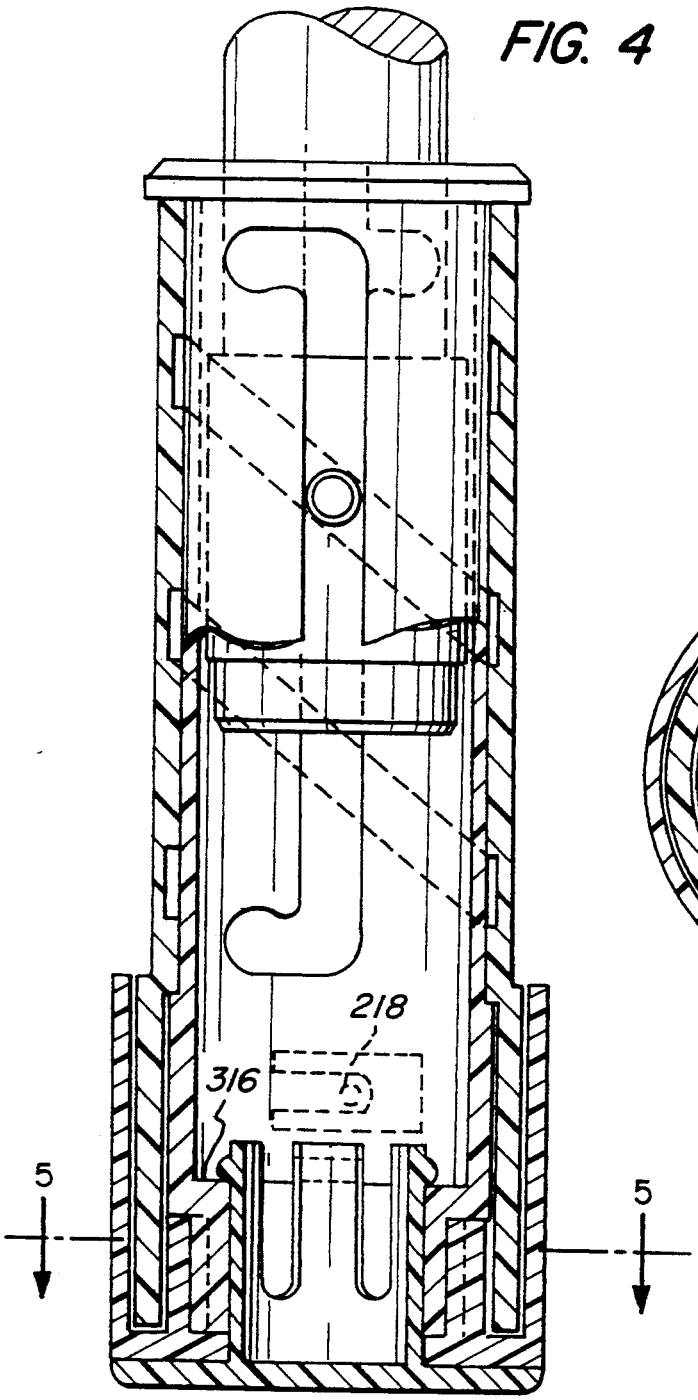
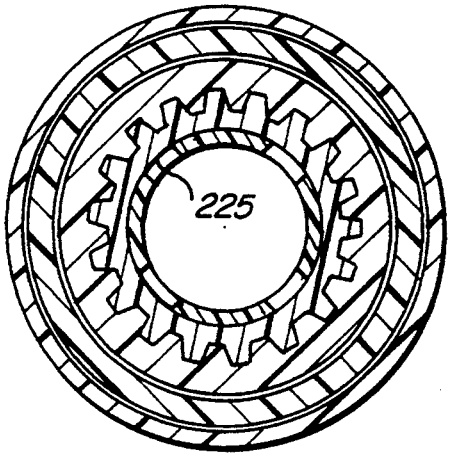
FIG. 5

DISPENSER WITH REPLACEABLE COSMETIC HOLDER

TECHNICAL FIELD

The invention relates to improved containers for cosmetics such as lipstick and, especially, to those with refills that require proper coupling with a reusable base container before use.

Economic and environmental concerns are providing incentives to reduce the production and use of disposable packaging. In the field of cosmetic dispensers, packages are of considerable complexity and cost—making it advantageous to develop reusable packages. However, cosmetic stick dispensers are typically only partially reusable. Refilling must be permitted without touching the cosmetic. Therefore, the structure surrounding the stick cannot be easily reused. This makes it economic to employ a reusable decorative outer body structure.

Unfortunately, the provision of refillable dispensers brings problems as well as benefits. The need to make the refills easy to replace, can make dislodging them too easy during use or while simply carrying them in a pocket or purse.

Other problems concern quality and use. Some replaceable elements for cosmetic dispensers are of inferior quality. Also, use is sometimes attempted by the consumer without insertion into the outer case. The availability of inferior refills can create problems for a consumer who mistakenly believes that look-alike products perform the same. And, the ability to improperly use a refill without the base container, can result in damage to purses and clothes. And damage can cause loss of good will for the manufacturer despite the fact that damage was the result of improper use.

The problems associated with refillable cosmetic dispensers are matters of serious concern to reputable manufacturers.

BACKGROUND ART

Conventional dispensers for lipstick and like cosmetics include a mechanism to move a cosmetic stick between retracted and extended positions. These mechanisms typically include an outer cam sleeve, an innerbody rotatable inside the cam sleeve, and an elevator cup. These elements are arranged so that relative rotation between the cam sleeve and the innerbody, axially propels and retracts the elevator cup which holds a cosmetic stick. Typically, a pair of lugs on the cup, track a pair of axial slots in the innerbody and a helical groove in the cam sleeve, as shown, for example, in: Hultgren, U.S. Pat. No. 3,298,509; Oses, U.S. Pat. No. 4,666,324; and Ackermann and Holloway, U.S. Pat. No. 5,186,561. The disclosures of these patents are incorporated herein by reference.

In U.S. Pat. No. 4,505,607, Sugiyama discloses a cosmetic container having an interchangeable cosmetic-holding component. The container has an integrally-molded, single-piece bottom piece (holder) and a top, cosmetic-carrying component which snap fits with a polygonal-shaped projection on the holder. The construction is designed to enable simple and easy interchange of cosmetic-holding components. However, the desired ease of disassembly can cause problems in the normal course of being carried in a pocket or purse. This can also result in the components separating during use, causing embarrassment, frustration or possible damage to clothing or the cosmetic itself. The ease of replacement and the sturdiness during carriage and use, each limits the other with this construction.

There remains a need for a dispenser for cosmetics such as lipstick, having a feature which enables replacement of an internal portion, and reuse of an exterior decorative body, without either permitting use outside of the mating body or requiring loss of operational integrity to achieve ease of inserting a replacement cosmetic stick.

DISCLOSURE OF THE INVENTION

It is an object of the invention to provide an improved cosmetic dispenser having a feature which enables replacement of the cosmetic portion, thereby providing economic advantages for the consumer and reduced environmental impact.

It is a further object of the invention to provide such a dispenser with a feature which restricts usage of the refill element apart from a mating base.

It is a further object of the invention to provide such a dispenser that can withstand the rigors of use and carrying, while still being easy to refill.

It is yet another object of preferred aspects of the invention to provide a cosmetic container having all of the above features and advantages, which is constructed of plastic but provides the feel, heft and operation of a precision-made metal container.

These and other objects are realized by the invention which provides a cosmetic dispenser with a refillable feature and a refill cartridge for use therewith.

The refill cartridge of the invention comprises a cosmetic holder having: a tubular innerbody having an open top, an open bottom, an upper body wall, and a lower body wall having an cylindrical inner surface and an outer surface configured to transmit rotational force to said innerbody; a tubular cam sleeve surrounding said innerbody over substantially the entire length of said innerbody; and, an elevator cup within said innerbody.

The cosmetic dispenser of the invention comprises:

a base element having a tubular outer wall having an inside surface, an open top, a bottom wall having a central opening, an interior wall upstanding from said bottom wall, said interior wall having an outer-wall-facing surface and a center-facing surface, said outer wall and said interior wall being coaxial to thereby define an annular space between said outer-wall-facing surface of said interior wall and said inside surface of said outer wall;

cosmetic holder comprising a tubular innerbody having an open top, an open bottom, an upper body wall, and a lower body wall having an inner surface and an outer surface, wherein said outer surface of said lower body wall is configured to engage said center-facing surface of said interior wall of said base element, a tubular cam sleeve surrounding said innerbody over substantially the entire length of said innerbody and seated in said annular space in said base element, and an elevator cup within said innerbody; and retaining means extending through said central opening in said bottom wall of said base element to secure said base element to said cosmetic holder.

BRIEF DESCRIPTION OF THE DRAWINGS

The invention will be better understood and its advantages will be better appreciated from the following detailed description, especially when read in light of the accompanying drawings, wherein:

FIG. 4 is a cross-sectional view of the dispenser of FIG. 1, taken on a plane passing through the longitudinal axis of the dispenser, the axis represented generally by the dot-and-dash line shown in that figure; and FIG. 5 is a cross-sectional view of the dispenser of FIG. 1, taken along line 5—5 in FIG. 4.

DISCLOSURE OF A PREFERRED EMBODIMENT

Figure 1:
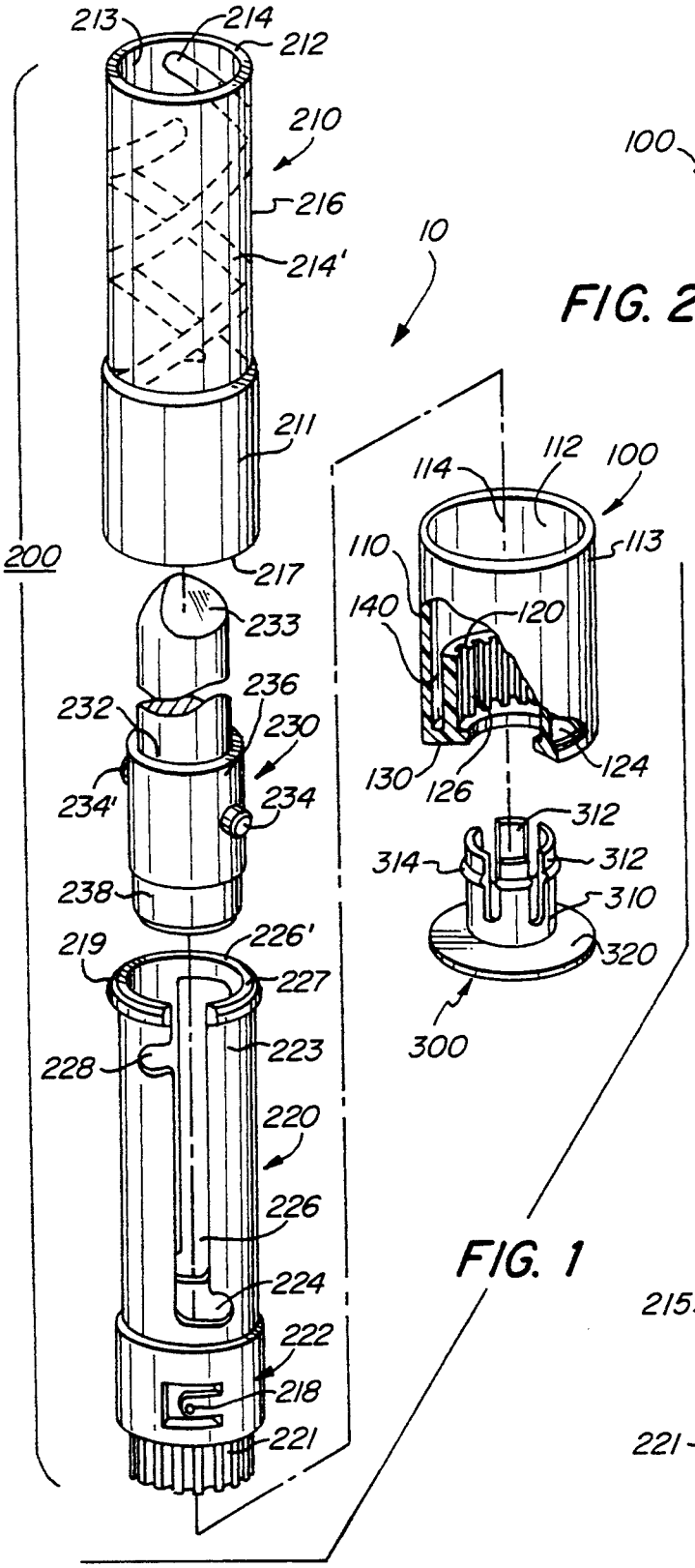
FIG. 1 is an exploded perspective view of the principal elements in a preferred embodiment of a cosmetic dispenser of the invention, partially cutaway showing some of the detail of a base element.
Figure 2:
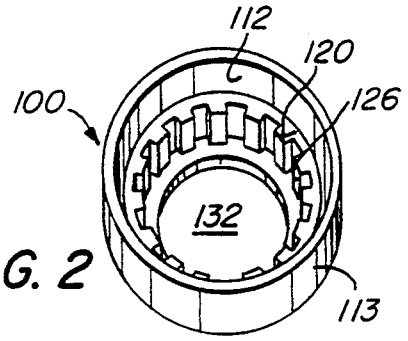
FIG. 2 is a perspective view, partially cut away to illustrate the structure of the base element shown in FIG. 1 in greater detail.
Figure 3:
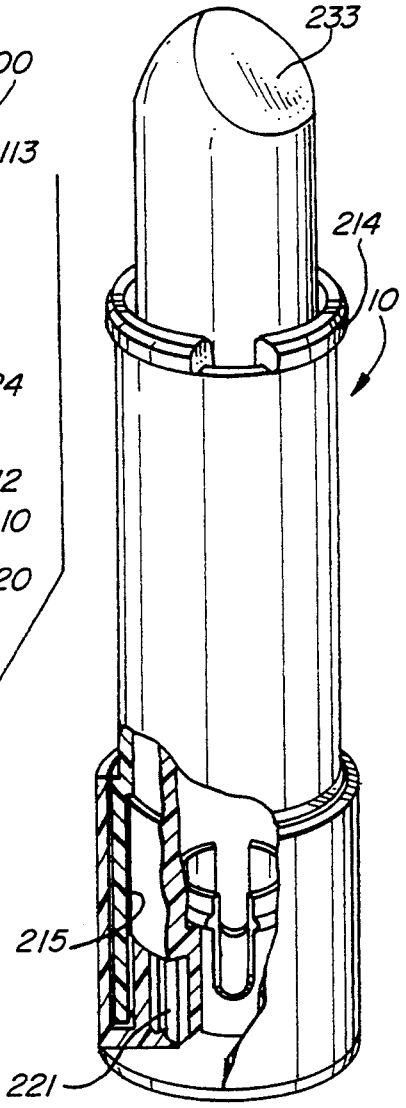
FIG. 3 is a perspective view, partially cut away, of an assembled cosmetic dispenser of the invention.

Referring now to the Figures, where like elements are identified by like numbers, a cosmetic dispenser is shown generally as 10 in FIG. 1. As shown, the dispenser 10 comprises a base element 100, a cosmetic holder 200, and a retaining means 300. While shown in exploded view in FIG. 1, these components are shown assembled in vertical cross section in FIG. 4.

The base element 100 is shown to include a tubular outer wall 110, a tubular internal wall 120, and a bottom wall 130. The cosmetic holder 200 is shown to include a tubular cam sleeve 210, a tubular inner body 220, and an elevator cup 230. The retaining means 300 is shown to have a split upstanding wall 310 and a flat stop 320.

The cam sleeve 210 is dimensioned to extend over the entire length of the innerbody 220 to inhibit the relative movement of these two elements if not properly connected to the base element 100. The base element is configured to fit between them and enable the user to impart relative torque as necessary for operation. Integrity during use and carriage is enabled by the separate retaining means 300.

Reference is made to FIGS. 1–5 to describe the detail of a preferred embodiment of a base member 100 of the invention. The outer wall is shown with an inner surface 112 and an external surface 113. The inner surface 112 is shown as cylindrical to permit ease of movement relative to the adjacent lower surface 211 of cam sleeve 210. The base element has an open top 114 and a bottom wall 130 having a central opening 132.

Interior wall 120 is shown upstanding from bottom wall 130, and has an outer-wall-facing surface 124 and a center-facing surface 126. The outer wall 110 and interior wall 120 are shown as coaxial and define an annular space 140 between them. In particular, outer-wall-facing surface 124 of the interior wall 120 and the inner surface 112 of outer wall 110 face each other to define the annular space 140.

As will be explained in greater detail below, center-facing surface 126 is configured to prevent slippage between the base element 100 and innerbody 220. While many configurations, such as keyways and geometric shapes, are suitable, the illustrated gear tooth configuration is preferred.

Cosmetic holder 200 is the heart of the refill cartridge of the invention and can be of conventional construction with the exception of the structure which inhibits use apart from the base element, but still permits it to be firmly secured against displacement. The figures show cam sleeve 210, a tubular innerbody 220, and an elevator cup 230. Preferably, the improved containers are economical to manufacture, give the feel of high quality, and include refill components that are easily interchanged.

Cam sleeve 210 is rigid and tubular and has a lower end 217 an upper end 212. Inner wall surface 213 of cam sleeve 210 is shown to include two internal helical threads 214 and 214' formed in the wall through the wall surface 213. At least one such helical thread is required, but when two are provided, as is preferred, they can be located 180 degrees apart and extend along a substantial length of the inner surface 213 of the wall of cam sleeve 210. Cam sleeve 210 has an unthreaded lower inner wall segment 215 at its lower end 217. An ornamental outer shell (not shown) such as a brass tube may be fitted over the outer wall surface 216 of the cam sleeve 210 for decoration.

Innerbody 220 is also tubular and has a lower body wall 222 and an upper body wall 223. The lower body wall 222 of innerbody 220 has an outer surface 221 and inner surface 225. The entire innerbody 220 is shown fitted within the cam sleeve 210. At least one, and preferably two, longitudinal tracks (e.g. 226 and 226') extend along the axial length of the innerbody 220 and through upper body wall 223 along a substantial length of the innerbody 220. Preferably, one of the longitudinal tracks, e.g. 226, extends to the upper end 227 of the innerbody 220 so that it is open at its upper end. The other longitudinal track preferably does not so extend and is closed at its upper end.

The longitudinal tracks 226 and 226' are shown to have track segments 228 and 229 at upper and lower positions, respectively. As shown, segments 228 and 229 preferably extend perpendicularly from the longitudinal tracks 226 and 226'. Preferably, the upper lateral tracks 228 extend in the opposite direction from the lower lateral tracks 229. The upper lateral track segments 228 assist locking the elevator cup 230 in an extended position for application of a cosmetic.

The innerbody 220, the cam sleeve 210, and the elevator cup 230 are configured and assembled so that rotation or application of a swivel torque to the cam sleeve 210 relative to innerbody 220 raises and lowers elevator cup 230 to extend and withdraw a cosmetic stick held in the elevator cup. The cam sleeve 210 and innerbody 220 are preferably secured together by a retaining lip 219.

It is a prime feature of the invention that such relative movement and, thus, use of the dispenser, cannot be achieved unless the cosmetic holder is positioned within a suitable base element. The provision of an extended lower cam sleeve wall 211 to cover the lower body wall of the innerbody 220, as described above and shown, is effective in this regard. This structure requires that the lower section of the cam sleeve fit into the annular space 140 in the base element for free rotation, while the center-facing surface 126 of the interior wall 120 of the base element 100 mates with a complementary configuration on the outer surface 221 of the innerbody 220. And, it is an advantage of the invention that this same structure permits retaining means 300 to be inserted through the central opening 132 in bottom wall 130 of the base element to firmly engage the parts for operation while still permitting ease of disassembly for the purpose of changing refill cartridges.

The retaining means 300 is shown to have a split upstanding wall 310 and a flat stop 320. The individual segments 312 of the upstanding wall 310 engage the inner surface of the lower body wall of innerbody 220. By virtue of bead 314 near the terminal ends of the segments 312, when inserted especially as shown seated firmly at step 316 inside lower body wall 222, the retaining means is firmly secured against accidental displacement but is easily removed when intended. The stop 320 can be of any convenient shape, either conforming neatly to the shape of the base element 100 or having a detail which facilitates gripping for removal.

Again referring to the drawings and describing the preferred structure which permits the feel of a metal container while making it out of plastic, it can be seen that at least one and preferably two resilient flex tabs 218 are formed with and attached to the lower body wall 222 of the innerbody 220. These tabs provide a smooth, precision feel during operation of the dispenser. When two such tabs are employed, they are preferably located about 180 degrees apart.

Elevator cup 230 is generally cylindrical and has a chamber 232 for containing a stick 233 cosmetic preparation such as lipstick. The cup 230 is fitted into the innerbody 220 and has at least one, and preferably two, cam follower lugs 234 and 234' for seating in and following in the longitudinal tracks 216 and 216' of the innerbody 210 and the helical threads 214 and 214' of the cam sleeve 210. The lugs 234 and 234' are located 180 degrees apart and have a sufficient length to extend through the longitudinal tracks 216 and 216' to engage the helical threads 214 and 214'. The cup 230 preferably has an upper segment 236 and a lower skirt 238 of reduced radius located below the lugs 234 and 234'. These can alternatively be cutouts on opposed sides, preferably as rectangular flat areas located below the lugs. The cup 230 has a lesser radius in skirt 238 than in the upper segment 236. The reduced radius below the lugs 234 and 234' provide the elevator cup 230 with sufficient clearance to be retracted into the innerbody 220 to a limit of longitudinal travel without interference between the flex tabs 218 and the elevator cup 230.

Cup 230 is movable in an axial path in a conventional manner by relative rotation of the innerbody 220 and cam sleeve 210 by virtue of the lugs 234 and 234' seating in the helical threads 214 and 214' of cam sleeve 210 and the longitudinal tracks 226 and 226' of innerbody 220. The relative rotation of the cam sleeve 210 and innerbody 220 causes the cup 230 to move axially to propel the elevator cup 230 to an extended position, and relative rotation in the opposite direction causes the elevator cup 230 to withdraw to a retracted position. In the preferred embodiment, the helical threads 214 and 214' are right hand threads in the cam sleeve 220 and have a thread pitch of about 30 degrees so that each makes one complete revolution as the cup 230 traverses the length of the dispenser 10. This is desirable as only a single turn is needed to fully activate the dispenser 10.

The innerbody 220, the elevator cup, and the cam sleeve 210 are preferably formed by molding from a thermoplastic such as styrene. The flex tabs are molded into the innerbody. The base member 100, is preferably made by injection molding of styrene material. The retaining means 300 is preferably made by injection molding.

Typically, a cap (not shown) will also be provided with the dispenser 10. Such a cap has a lower end suited for fitting over the cam sleeve and its decorative shell, and can be frictionally mounted. For decorative enhancement, the cap and the base element may also have decorative shells fitted over them. These decorative shells may be affixed to their respective underlying structural components by gluing and/or by forming their ends to clip onto the ends of the cam sleeve, cap and innerbody lower end.

The present invention therefore provides a new and useful cosmetic dispenser with a removable feature which corrects the problems of the prior art and to a greater extent assures proper use.

The above description is for the purpose of teaching the person of ordinary skill in the art how to practice the invention, and it is not intended to detail all of those obvious modifications and variations of it which will become apparent to the skilled worker upon reading the description. It is intended, however, that all such obvious modifications and variations be included within the scope of the invention which is defined by the following claims. The claims are meant to cover the claimed elements and steps in any arrangement or sequence which is effective to meet the objectives there intended, unless the context specifically indicates the contrary.

I claim:

1. A refillable cosmetic dispenser, comprising:

a base element having a tubular outer wall having an inside surface, an annular bottom wall having a circular central opening, a tubular interior wall upstanding from said bottom wall, said tubular interior wall having a diameter larger than a diameter of said central opening to define an inner annular space, said interior wall having an outer-wall-facing surface and a center-facing surface, said outer wall and said interior wall being coaxial to thereby define an outer annular space between said outer-wall-facing surface of said interior wall and said inside surface of said outer wall, said outer wall having a height, and said inner wall having a height which is less than said height of said outer wall;

a cosmetic cartridge comprising a tubular innerbody having an open top, an open bottom, an upper body wall, and a lower body wall having an inner surface and an outer surface, said outer surface of said lower body wall matingly engaging with said center-facing surface of said interior wall of said base element to prevent rotation of said innerbody relative to said base element, said lower body wall having a lesser diameter than a diameter of said upper body wall wherein said lower body wall is concentrically inwardly located from said upper body wall with a step therebetween, said upper body wall being supported by said tubular interior wall of said base element, said lower body wall being received in said inner annular space of said base element, and said upper body wall having a longitudinal track extending therethrough, a tubular cam sleeve surrounding and receiving. therein said innerbody and having substantially the same length as said innerbody, said cam sleeve having a tubular lower wall seated in said outer annular space in said base element, and having an inner surface with a helical thread extending along a substantial length of said cam sleeve, and an elevator cup within said innerbody for containing a cosmetic preparation having a cam follower lug which extends through said longitudinal track to engage said helical thread; and a retaining plug having a lower retaining wall located against said lower wall of said base element and an upwardly extending tubular retainer wall having retaining arms, said tubular retainer wall extending through said central opening in said bottom wall of said base element and being located adjacent to and extending through said lower body wall of said innerbody, said retaining arms catching and engaging said step between said lower body wall and said upper body wall of said innerbody to thereby secure said base element to said cosmetic cartridge;

and wherein rotation of said base element causes rotation of said innerbody relative to said cam sleeve to thereby retract or extend said elevator cup.

2. A cosmetic dispenser according to claim 1, wherein said mating surfaces have a gear tooth configuration.

3. A cosmetic dispenser according to claim 1, which further includes a cosmetic stick held in said cup.

* * * * *